US007856792B2

(12) United States Patent
Koga et al.

(10) Patent No.: US 7,856,792 B2
(45) Date of Patent: Dec. 28, 2010

(54) BAG FILLING AND PACKAGING APPARATUS

(75) Inventors: Shoichi Koga, Iwakuni (JP); Tohru Yoshikane, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 180 days.

(21) Appl. No.: 12/317,893

(22) Filed: Dec. 30, 2008

(65) Prior Publication Data

US 2009/0188209 A1 Jul. 30, 2009

(30) Foreign Application Priority Data

Jan. 8, 2008 (JP) ..... 2008-001277

(51) Int. Cl.

| | |
|---|---|
| ***B65B 57/14*** | (2006.01) |
| ***B65B 57/16*** | (2006.01) |
| ***B65B 39/12*** | (2006.01) |
| ***B65B 39/14*** | (2006.01) |

(52) U.S. Cl. ..... 53/53; 53/54; 53/55; 53/58; 53/493; 53/570; 53/284.7; 141/139; 141/166

(58) Field of Classification Search ..... 53/52–58, 53/493, 570, 284.7, 384.1; 141/138, 139, 141/166, 316, 317; *B65B 57/12, 57/14, 57/16, B65B 39/12, 39/14, 43/46*

See application file for complete search history.

(56) References Cited

U.S. PATENT DOCUMENTS

| | | | | |
|---|---|---|---|---|
| 2,330,361 | A * | 9/1943 | Howard | 53/570 |
| 2,715,807 | A * | 8/1955 | Irmscher | 53/52 |
| 2,951,514 | A * | 9/1960 | Flack | 141/139 |
| 2,996,855 | A * | 8/1961 | Bergeron et al. | 53/53 |
| 3,275,043 | A * | 9/1966 | Dobbyn | 53/55 |
| 3,340,679 | A * | 9/1967 | Johnson | 53/570 |
| 3,982,376 | A * | 9/1976 | Ikeda | 53/53 |
| 4,509,313 | A | 4/1985 | Koppe | |
| 5,555,709 | A * | 9/1996 | Savigny et al. | 53/570 |
| 2003/0074866 | A1 * | 4/2003 | Koppe | 53/570 |
| 2008/0156011 | A1 * | 7/2008 | Culley et al. | 62/228.1 |

FOREIGN PATENT DOCUMENTS

| | | | |
|---|---|---|---|
| DE | 203 09 914 | | 9/2003 |
| EP | 1 792 830 | | 6/2007 |
| JP | 63272601 | A * | 11/1988 |
| JP | 05016924 | A * | 1/1993 |
| JP | 06008914 | A * | 1/1994 |
| JP | H08-005472 | | 1/1996 |
| JP | H08-048312 | | 2/1996 |
| JP | H9-095301 | | 4/1997 |
| JP | 2745203 | | 4/1998 |

(Continued)

*Primary Examiner*—Stephen F Gerrity
(74) *Attorney, Agent, or Firm*—DLA Piper LLP (US)

(57) ABSTRACT

A bag filling and packaging apparatus including hollow guide members that are disposed below ascending/descending hoppers and guide product dropping from hoppers into the interior of bags, the guide members being raised/lowered and moved together with the hoppers in a filling region. The guide members comprise a pair of opening and closing guide frames that are disposed to face each other; and when clogging is detected in a guide member, its guide frames are repeatedly opened and closed while moving through a non-filling region, thus promoting the dropping of product. Directly below the guide members is provided a receiving member that receives the product.

10 Claims, 6 Drawing Sheets

FOREIGN PATENT DOCUMENTS

| | | | |
|---|---|---|---|
| JP | 2000177711 A | * | 6/2000 |
| JP | 2001-072004 | | 3/2001 |
| JP | 2002-255119 | | 9/2002 |
| JP | 2002-302227 | | 10/2002 |
| JP | 2002-308223 | | 10/2002 |
| JP | 3342262 | | 11/2002 |

* cited by examiner

BAG FILLING AND PACKAGING APPARATUS

BACKGROUND OF THE INVENTION

1. Field of the Invention

The present invention relates to a bag filling and packaging apparatus in which a plurality of grippers are moved continuously or intermittently along a racetrack-shaped annular track, and in the process of this movement of the grippers, packaging operations including, among others, supply of bags to the grippers, holding of the edges of bags by the grippers, opening of the bag mouth, filling of bags with product, and sealing of the bag mouth are performed.

2. Description of the Related Art

U.S. Pat. No. 4,509,313 discloses a bag filling and packaging apparatus, and this bag filling and packaging apparatus comprises an endless chain that continuously moves along a racetrack-shaped annular track and a plurality of pairs of grippers that are disposed at equal intervals along the length of the endless chain and are moved together with the endless chain, and it further includes a bag supply device, a bag mouth opening device, a filling device and a sealing device that are among others disposed along the annular track. The bag supply device and bag mouth opening device are disposed along one linear section of the annular track, while the filling device includes a plurality of ascending/descending hoppers that are disposed above one semicircular section of the annular track (the semicircular section being on the downstream side of the linear section) and are moved along their own circular track which is concentric to the arc-shaped section of the annular track; and further the sealing device is disposed along the other linear section of the annular track.

In this bag filling and packaging apparatus, during the process of the movement of the grippers, packaging operations are performed including supply of bags to the grippers by the bag supply device, holding of the edges of bags by the grippers, opening of the bag mouth by the bag mouth opening device, filling of bags with product via the hoppers by the filling device, and sealing of the bag mouth by the sealing device. The hoppers (and their bottom-end openings in particular) are disposed at equiangular intervals (the same equiangular intervals as between the grippers when the grippers are traveling upon the semicircular sections of the annular track), and they are thus moved in a rotary manner synchronized with the grippers while the grippers are rotating above the circular track along the semicircular sections of the annular track. During the period of this rotary motion, the hoppers drop down from a position directly above the bags held by the grippers (such position being a standby position) to a filling position (where a product is filled in the bags), their bottom-end openings are inserted into the mouths of the bags, the product is introduced into the hopper and then drops from the bottom-end openings into the bags, and the hoppers are then raised and their bottom-end openings are removed out from the mouths of the bags, and the hoppers return to the standby positions. The semicircular region of the circular track of the hoppers during which a product filling step takes place is called the "filling region," while the other semicircular region where the circular track of the hoppers diverges from the annular track of the grippers (where the hoppers and grippers are not in synchronized rotary motion) is called the "non-filling region," and in this non-filling region the hoppers are at the standby positions.

The bag filling and packaging apparatus described above is able to perform bag filling and packaging with high productivity; however, in cases in which the bottom-end openings of the hoppers are set to a relatively small size to match the size of the bag mouths, product can easily clog the hopper, and the apparatus has no means of detecting or clearing such clogging if it occurs.

In contrast, in the filling device disclosed in the Japanese Patent No. 3,342,262, a pair of alligator frames that are able to open and close along and an air cylinder that opens and closes the alligator frames are disposed at the bottom of the hopper, so that the bottom ends of the closed alligator frames are inserted into the bag mouth and then opened, thus introducing the product into the bag via the hopper and alligator frames. With this type of opening/closing alligator frame provided at the bottom of the hopper, there is no need to make the bottom-end opening of the hopper excessively small, and as a result, it is possible to prevent clogging of product inside the hopper; and also, by repeatedly opening and closing the alligator frames inserted in the bag mouths, the action of the product dropping into the bag is promoted, and it is thereby possible to prevent clogging of product in the alligator frame (even if temporary clogging occurs, it can be automatically cleared).

However, even if the technology of the Japanese Patent No. 3,342,262 were to be applied "as is" to a bag filling and packaging apparatus of the type presented in the U.S. Pat. No. 4,509,313, it is still not possible to take sufficient time to allow the alligator frames inserted in the bag mouth to open and close; and a problem arises in which if sufficient time is taken, then the original advantage of high productivity is degraded.

On the other hand, the Japanese Patent No. 2,745,203 discloses a method of detecting clogging in a hopper by means of detection sensors or the like that are disposed in the upper portion of the hopper. Though the Japanese Patent No. 2,745,203 does not recite what is to be done after hopper clogging is detected, in the case in which clogging of the hopper is detected, typically the operation of the packaging apparatus is immediately halted, so that the clogging is cleared manually, and the operation of the packaging apparatus is then restarted.

However, in the bag filling and packaging apparatus of the type disclosed in the U.S. Pat. No. 4,509,313, halting the operation of the packaging apparatus each time the clogging is detected in one of the plurality of hoppers would degrade the original advantage of high productivity.

BRIEF SUMMARY OF THE INVENTION

The primary object of the present invention is to provide a bag filling and packaging apparatus that automatically clears clogging of product to be packaged without decreasing productivity in the event that clogging occurs in hoppers in the bag filling and packaging apparatus that has a racetrack-shaped track.

Another object of the present invention is to provide a bag filling and packaging apparatus which is controlled so that the productivity is not impaired even when hopper clogging is detected, and such is done without (immediately) halting the operation of the packaging apparatus.

The above-describe objects are accomplished by a unique structure of the present invention for a bag filling and packaging apparatus that includes:

- an endless chain that travels along a racetrack-shaped annular track, and
- a plurality of pairs of grippers that are provided on the endless chain at equal intervals along a length of the endless chain and moved together with the endless chain, and further a bag supply device, a bag mouth opening device, a filling device and a sealing device that are among others disposed along the annular track;

wherein the filling device has a plurality of ascending/descending hoppers that are provided above one of arc-shaped sections of the annular track and are moved, in synchronism with the grippers, along its own circular track which is concentric to the one of the arc-shaped sections, and during a movement of the grippers, a packaging operation is performed including, among others, supply of bags to the grippers by the bag supply device, holding of edges of the bags by the grippers, opening of a bag mouth by the bag mouth opening device, filling of the bag with product by each one of the hoppers by the filling device, and sealing of the bag mouth by the sealing device; and in this bag filling and packaging apparatus:

a guide member that is hollow inside and guides product dropping from the hopper into the bag is provided under each one of the hoppers;

the guide member is comprised of a pair of guide frames, which are disposed to face each other and able to open and close, and is moved and raised/lowered together with the each one of the hoppers; and when the pair of guide frames are closed, the guide member narrows at a bottom thereof and a lower end thereof can thus be inserted into the bag mouth, and when the guide frames are opened, the guide member widens at its lower end;

a guide frame actuating means that opens and closes the pair of guide frames is provided;

the pair of guide frames are repeatedly opened/closed by the guide frame actuating means in an arc-shaped non-filling region of a circular track of the guide member; and a receiving member that receives a product that drops from the guide member is provided at a position directly below the guide member in the non-filling region.

The movement of the endless chain may be continuous at a fixed speed or intermittent at predetermined intervals. It should be noted that the "non-filling region" refers to those regions of the circular track of the hopper and guide member other than the region wherein the hopper and guide member are moved synchronously with grippers and the filling operation (product filling step) is performed (which is called the filling region).

This bag filling and packaging apparatus of the present invention is most strongly characterized in that the guide frames constituting the guide member is repeatedly opened and closed in the non-filling region of the circular track of the guide member and that a receiving member is provided at a position directly below the guide member in this region. The non-filling region of the circular track of the guide member is a region where, in other words, the guide member leaves the product filling step, so that by repeatedly opening and closing the guide frames in this region, in the case in which product is clogged within the guide member, the product will drop in this region so the clogging of the guide member can be cleared and, moreover, there is no need to take excessive time in the product filling step and productivity is not degraded. The receiving member has a role of receiving product that drops from the guide member at this time.

The opening and closing operations of the guide frames of the guide member in the non-filling region can be performed for all guide members moving through this region (regardless of whether or not they are clogged with product), or it can be performed only when clogging with product is determined to be present based on the detection signals from the first detection sensor (to be described later).

The above-described bag filling and packaging apparatus may have the following structures:

(1) It may includes a first detection sensor, which detects the presence of product within the guide member immediately after the product filling step (or immediately after filling the bag with the product), and a control unit, which determines the presence of clogging of product based on detection signals from the first detection sensor and controls the actions of the guide frame actuating means. The first detection sensor can be provided near the starting end of the non-filling region, for example. Upon determining the presence of clogging of product, the control unit causes the guide frame actuating means to perform an action in which the guide frames of the guide member determined to be clogged with product are repeatedly opened and closed in the non-filling region. In this structure, the presence of clogging in the guide member is detected in the vicinity of the starting end of the non-filling region (immediately after the product filling step) and, in case of clogging, the guide frame is repeatedly opened and closed in the non-filling region to clear the clogging.

(2) The apparatus of the present invention can be provided with a first detection sensor, which detects the presence of product within the guide member immediately after the product filling step, a bad-bag ejecting device, which, at a position different from a product ejection position, opens the gripper and ejects bad bags that have been held by the grippers out of the apparatus, and a control unit, which determines the presence of clogging of product based on detection signals from the first detection sensor and controls the actions of the bad-bag ejecting device. The first detection sensor can be provided near the starting end of the non-filling region, for example. Upon determining that the clogging of product is present, the control unit determines a bag that is supplied with product from the guide member determined to be clogged with product to be a bad bag and causes the bad-bag ejecting device to perform an action to open the gripper corresponding to the guide member determined to be clogged with product (the gripper holding the bad bag). In this structure, a bag, which is supplied with product via the guide member that is determined to be clogged in the product filling step prior to this determination, is determined to be filled with only a part the product or is not filled completely, and thus this bad bag is determined to be a bad bag and ejected out of the apparatus at a position different from the normal product ejection position. This structure can be combined with the structure described above in paragraph (1).

(3) Furthermore, the apparatus of the present invention can be provided with a second detection sensor, which detects the presence of product within the guide member immediately before the product filling step (or immediately before filling the bag with the product), and a control unit, which determines the presence of clogging of product based on the detection signals from the second detection sensor and controls the actions of the filling device. The second detection sensor can be provided near the finishing end of the non-filling region, for example. Upon determining that the clogging of product is present, the filling device halts the supply of product to the hopper corresponding to the guide member determined to be clogged with product. A "guide member determined to be clogged with product based on the detection signals from the second detection sensor" means that the clogging with product was not cleared despite the guide frame being repeatedly opened and closed in the non-filling region. By halting the supply of new product to the hopper corresponding to the guide member wherein the clogging was not cleared, it is possible to prevent the wasteful supply of product and it becomes easier to clear the clogging when the guide frame is repeatedly opened and closed the next time in the non-filling region (if new product is supplied so that an excessive amount of product is contained in the hopper and guide member, it becomes even more difficult to clear the clogging). This structure is combinable with the structure described in paragraph (1) or (2) above.

(4) In the structure described above in paragraph (3), it is possible to design so that upon determining that a specific guide member is clogged with product a predetermined number of times in a row, the bag supply device halts the supply of bags to the gripper corresponding to the guide member determined to be clogged with product. After halting the supply of bags to the gripper corresponding to the specific guide member (the gripper that rotates synchronously under the hopper and guide member in the product filling step), the bag filling and packaging apparatus goes into the culling operation (see the Japanese Patent Application Publication No. H8-5472). In this structure, when the clogging of a specific guide member is detected a predetermined number of times in a row by the second detection sensor, the clogging of that guide member is deemed to be impossible to clear thereafter.

(5) Furthermore, in the structure described above in paragraph (3), it is possible to design so that upon determining that a specific guide member is clogged with product a predetermined number of times in a row, the operation of the bag filling and packaging apparatus is halted. In this structure, when the clogging of a specific guide member with product is detected a predetermined number of times in a row by the second detection sensor, the clogging of that guide member is deemed to be impossible to clear thereafter.

As seen from the above, in the present invention, the repeated opening and closing operation of the guide frames of a guide member (an operation for clearing the clogging with product) is performed in the non-filling region of the circular track of the guide member; accordingly, it is possible to clear the clogging without decreasing productivity even in the case in which clogging of guide members should occur.

In addition, even in the case in which that clogging is not cleared even after repeated opening and closing operations for the guide frames in the non-filling region, once clogging of a guide member is detected, the operation of the packaging apparatus is not immediately halted; instead, rather a predetermined number of attempts to clear the clogging of the guide frame are made, and if the clogging is cleared during this time, there is naturally no need to halt the operation of the packaging apparatus so that there is virtually no drop in productivity, and even in the case in which the clogging is not ultimately cleared, any decrease in productivity can be kept to a minimum by performing a culling operation.

BRIEF DESCRIPTION OF THE SEVERAL VIEWS OF THE DRAWINGS

FIGS. 5(*a*) and 5(*b*) are side views showing the open and closed states of a guide member; and.

DETAILED DESCRIPTION OF THE INVENTION

A bag filling and packaging apparatus according to the present invention will be described in detail below with reference to FIGS. 1-6.

Figure 1:
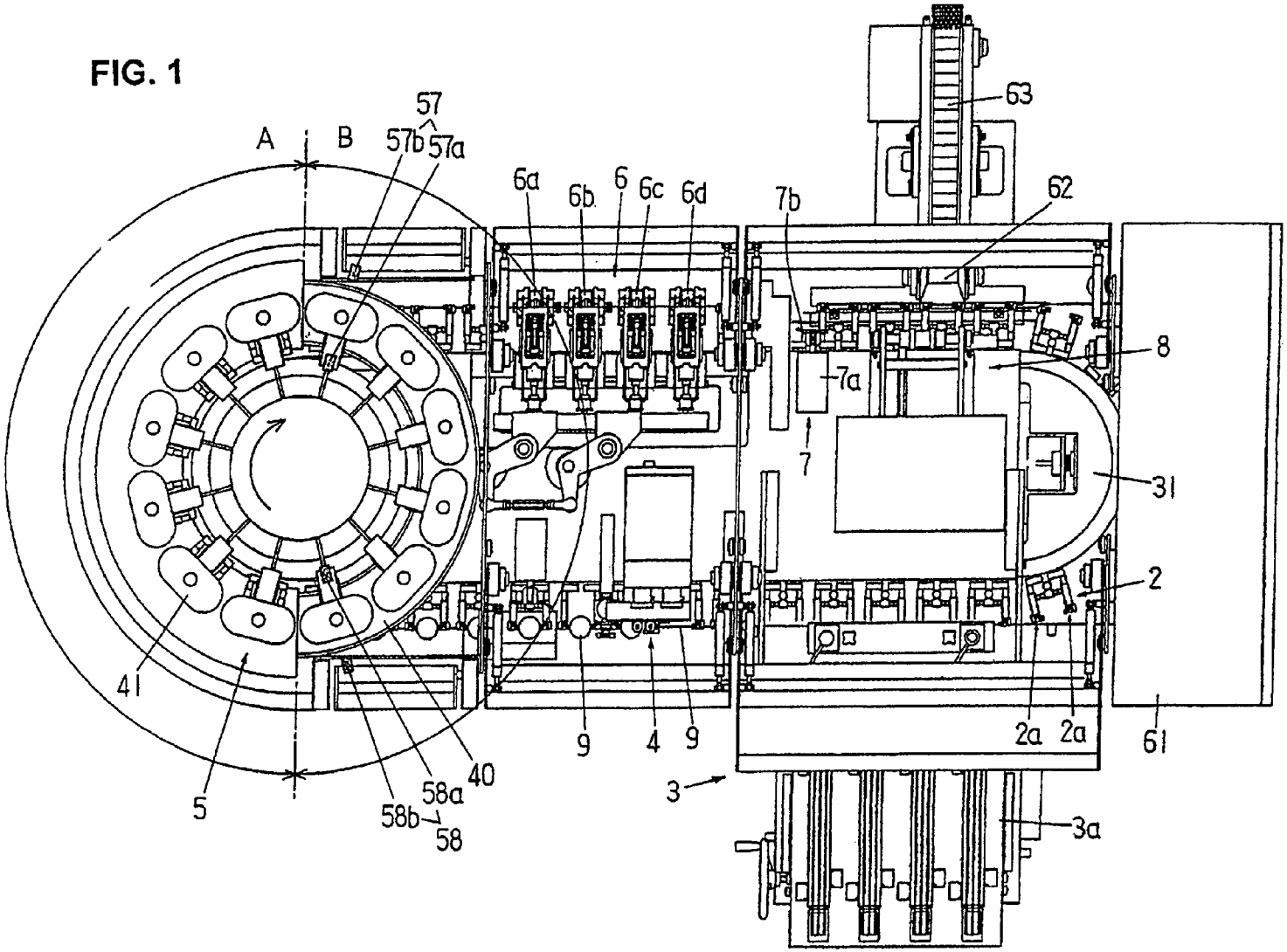
FIG. 1 is a top plan view of a bag filling and packaging apparatus according to the present invention.
Figure 2:
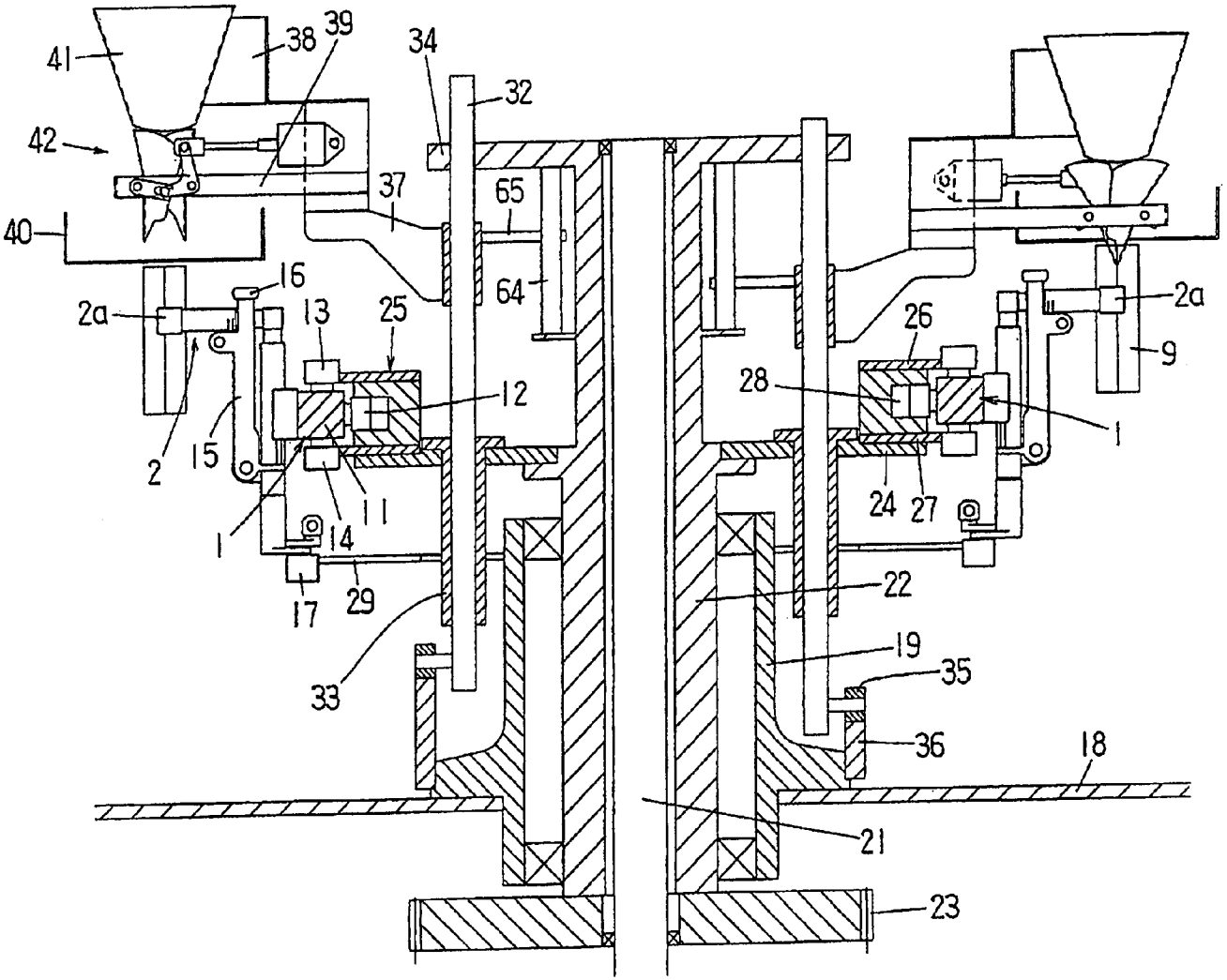
FIG. 2 is a cross-section right side view thereof.

As shown in FIGS. 1 and 2, this bag filling and packaging apparatus includes an endless chain 1 (see FIG. 2), that travels along a racetrack-shaped annular track, and a plurality of pairs of grippers 2, that are disposed at equal intervals along the length of the endless chain 1 and moved together with the endless chain 1. Along the annular track are provided, among others, a bag supply device 3, a bag mouth opening device 4, a filling device 5, a sealing device 6, a bad-bag ejecting device 7, a product-bag ejecting device 8. In the course of the grippers 2 moving in a rotary fashion along the annular track, various operations are performed including packaging operations and ejecting operations. The packaging operation includes, among others, supply of bags 9 to the grippers 2 by the bag supply device 3 and holding of the edges of bags by the grippers 2, opening of the bag mouths by the bag mouth opening device 4, filling of bags 9 with product by the filling device 5, and sealing (including cooling) of the bag mouth by the sealing device 6, and in addition if necessary, ejecting of bad bags by the bad-bag ejecting device 7. The ejecting operation includes, among others, ejection of product-bags (bags with product inside) by the product-bag ejecting device 8.

Endless chain 1, grippers 2 and the mechanism for operating the endless chain 1 are the same as those disclosed in the Japanese Patent Application Laid-Open (Kokai) No. 2002-302227.

The endless chain 1 comprises a plurality of links 11 that are endlessly linked via link shafts (not shown), and one pair of grippers 2 is, as best seen from FIG. 2, provided on the outside of each of the links 11. In addition, an inside guide roller 12 is rotatably provided on the inside of each link, and a top-side guide roller 13 and a bottom-side guide roller 14 are provided above and below each of the link shafts so as to be able to rotate within the horizontal plane.

Each of the grippers 2 has a pair of holders 2*a* and 2*a* at the ends of a pair of gripper arms. The holders 2*a* and 2*a* are used to hold and suspend a bag 9 at its both edges. These holders 2*a* and 2*a* are urged by springs (not shown) so as to be normally closed but are opened when an opening/closing lever 15 is moved toward the inside (by pressing an opening/closing roller 16 at the tip toward the inside). In addition, during the period when the grippers 2 are moving along the annular track, a cam roller 17 follows along an interval-adjusting cam 29 (FIG. 2 only shows a part of the interval-adjusting cam 29), so that the gripper arms open and close (and the gap between the holders 2*a* and 2*a* changes) within the horizontal plane at a predetermined timing.

As shown in FIG. 2, a stand 19 is provided to stand on the upper surface of the apparatus base 18, and in its center a fixed shaft 21 is provided vertically, while a hollow shaft 22 is rotatably supported between the stand 19 and the fixed shaft 21. The bottom end of the hollow shaft 22 is fixed to a gear 23 which is rotated at a fixed speed by a drive source (not shown). A table 24 is fixed to the hollow shaft 22, and a sprocket 25 is fixed to the periphery of the table. The sprocket 25 has top and bottom gears 26 and 27 and an intermediate support groove 28, where the top- and bottom-side guide rollers 13 and 14 are engaged with grooves formed at equal intervals around the periphery of the gears 26 and 27, and the inside guide roller 12 engages the interior of the support groove 28. In addition, the interval-adjusting cam 29 is disposed in a fixed manner below the table 24, while the cam roller 17 is in contact with the outside periphery of the interval-adjusting cam 29.

A fixed guide member 31 that has a guide portion semicircular in shape when viewed from above is further provided. The endless chain 1 is provided between the sprocket 25 and the guide portion so as to form an annular track comprised of circular sections at both ends and linear sections on both sides; and when the hollow shaft 22 rotates to rotate the sprocket 25, the chain travels clockwise in FIG. 1 continuously within the horizontal plane along the annular track. A guide rail along which the top- and bottom-side guide rollers 13 and 14 and inside guide rollers 12 travel is provided on the fixed guide member 31 and the linear sections of the annular track, and in addition, a plurality of interval-adjusting cams that the cam rollers 17 touches are installed along the linear sections on both sides of the annular track as disclosed in the above-described Japanese Patent Application Laid-Open No. 2002-302227.

The bag supply device 3 is the same as the empty-bag supply device disclosed in Japanese Patent Application Laid-Open No. 2002-308223. Combined with a conveyor magazine-style bag supply device 3*a*, the empty-bag supply device 3, as seen from FIG. 1, simultaneously supplies four bags to four pairs of grippers 2, one bag per gripper.

The bag mouth opening device 4 is the same as the bag mouth opening device disclosed in Japanese Patent Application Laid-Open No. 2002-255119.

The sealing device 6 comprises heat sealing units 6*a* and 6*b* which heat-seal the bag mouths between sealing bars and seal cooling units 6*c* and 6*d* which cool the bag mouth between cooling bars as in the same manner as the sealing unit disclosed in Japanese Patent Application Laid-Open No. 2001-72004. The heat sealing units 6*a* and 6*b* and the seal cooling units 6*c* and 6*d* are moved a predetermined distance so as to follow the grippers 2 (bags 9) at the same speed as them; and during this period, the sealing bars and cooling bars pinch to hold the bag mouths and then separated and then return to their original positions. In the shown example, two bags are heat-sealed at the same time by the heat sealing units 6*a* and 6*b*, and they are subsequently cooled at the same time by the seal cooling units 6*c* and 6*d*, so that heat-sealing and cooling are performed one time each for each bag.

The product-bag ejecting device 8 is the same as the opening/closing device (comprising an opening/closing member and its drive mechanism, etc.) disclosed in the above-described Japanese Patent Application Laid-Open No. 2002-302227; and with this product-bag ejecting device 8, the opening/closing roller 16 of each one of the grippers 2 arriving at a predetermined position is pressed inwardly by the pressing portion of the opening/closing member, thus opening the holders 2*a* and 2*b* so that the product-bags are dropped upon a chute 62 and carried out by a carry-out conveyor belt 63. Such an opening/closing device is also provided at the location of bag supply device 3, so that when bags 9 are supplied to grippers 2, the holders 2*a* and 2*b* open (provided that this is a type where this action is performed simultaneously on four pairs of the grippers 2).

The bad-bag ejecting device 7 is one in which a cam 7*b* is provided at the tip of the piston rod of an air cylinder 7*a*, and its function is the same as that of product-bag ejecting device 8. When the air cylinder 7*a* is actuated to move the cam 7*b* toward the inside, the opening/closing roller 16 of the gripper 2 arriving at that position (the bad-bag ejection position) is pressed inwardly by the cam 7*b*, the holders 2*a* and 2*b* are opened and the bag 9 (a bad bag) drops.

As shown in FIG. 2, a plurality of ascending/descending shafts 32 are supported by the table 24 secured to the hollow shaft 22 so that they are each able to be raised and lowered via support members 33; and even at flange portions 34, which are at the top end of the hollow shaft 22, the ascending/descending shafts 32 are supported so that they are able to be raised and lowered. A cam roller 35 is disposed at the bottom end of each of the ascending/descending shafts 32. When the table 24 rotates, the rollers 35 roll along the top of annular cams 36 secured to the outside periphery of the stand 19, and the ascending/descending shafts 32 are raised and lowered at the predetermined timing.

The ascending/descending shafts 32 are disposed at equiangular intervals on the table 24; and to each of the ascending/descending shafts 32, an ascending/descending member 37 is secured. A hopper mount 38 and guide member mount 39 are secured to each one of the ascending/descending members 37. A hopper 41 is secured to each hopper mount 38, and a guide member 42 is mounted to the guide member mount 39. A plurality of guide shafts 64 are vertically secured to the hollow shaft 22, while a protrusion 65 secured to each of the ascending/descending members 37 slidably engages the corresponding guide shaft 64, thus preventing rotation of the ascending/descending shafts 32 and ascending/descending members 37.

Figure 3:
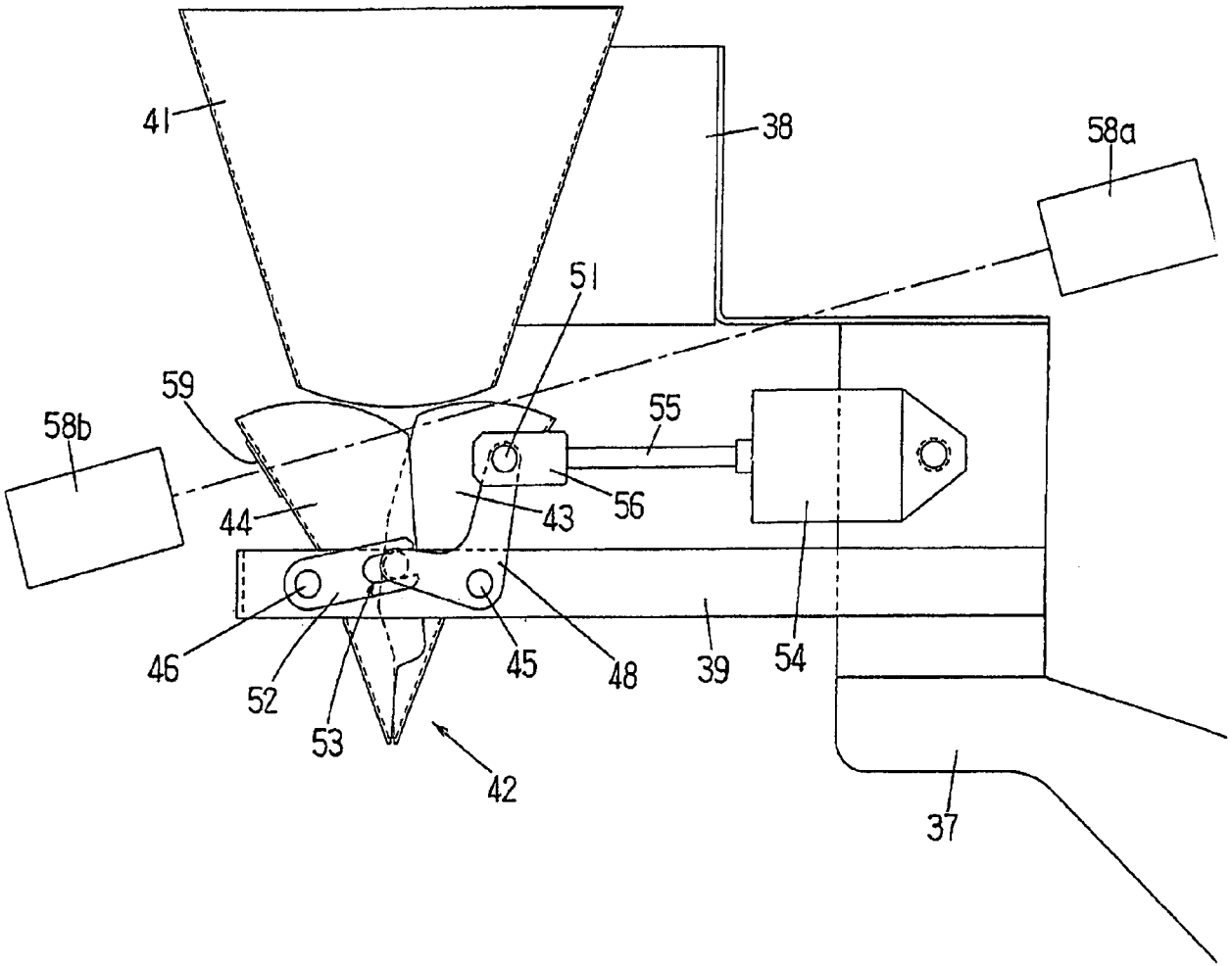
FIG. 3 is a side view of the hopper and the guide member thereof.
Figure 4:
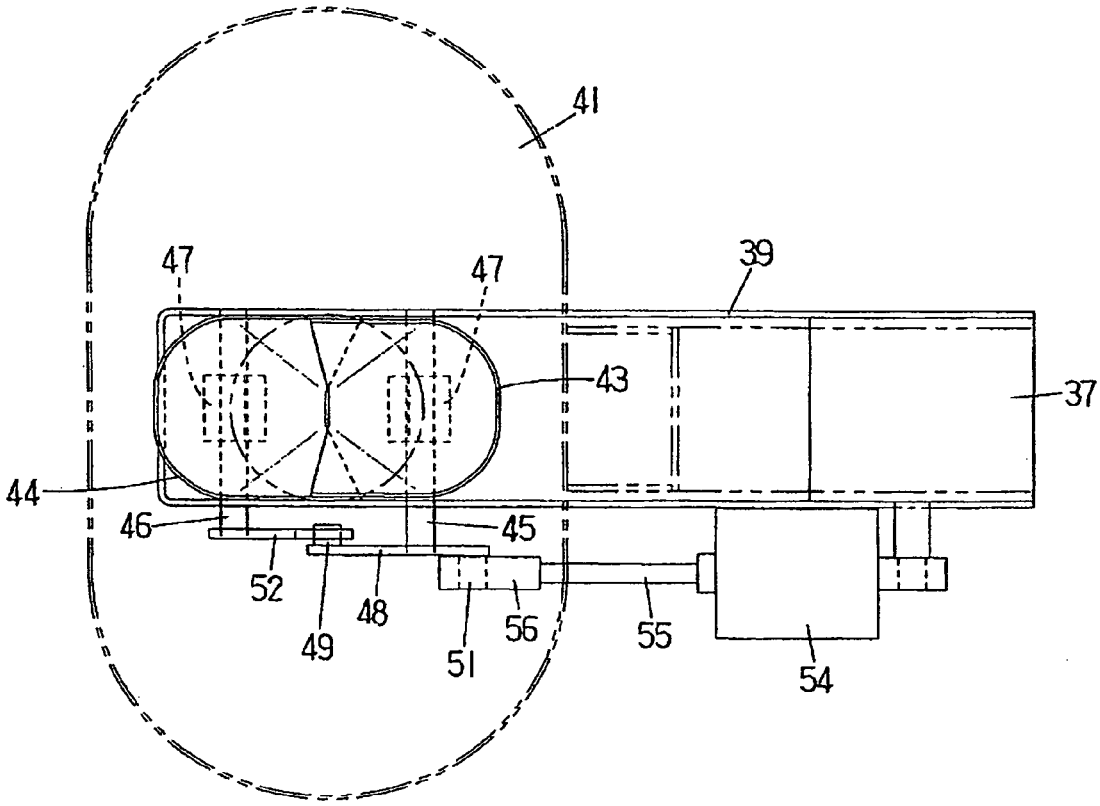
FIG. 4 is a top plan view thereof.

Each one of the guide members 42 has a hollow structure that comprises substantially gutter-shaped guide frames 43 and 44 disposed to face each other, which are similar to the pair of alligator frames disclosed in the above-identified Japanese Patent No. 3,342,262. As shown in FIGS. 3 and 4, a pair of support shafts 45 and 46 that are parallel to each other are rotatably supported horizontally on the guide member mount 39, and the guide frames 43 and 44 are secured to the respective support shafts 45 and 46 via brackets 47. An L-shaped lever 48 is secured, at its curved portion, to one support shaft 45; and an engaging shaft 49 is secured to one end of the L-shaped lever 48, while a link shaft 51 is secured to the other end of this lever 48. To the other support shaft 46, a rocking lever 52 is secured, and the engaging shaft 49 is slidably engaged to a groove-shaped opening 53 formed at one end of the rocking lever 52.

In addition, the tail end of an air cylinder 54 is swingably supported by ascending/descending member 37, and a linking rod 56 is secured to the front end of the piston rod 55 of this air cylinder 54 while the tip end of the linking rod 56 is rotatably fit to the link shaft 51.

Figure 5B:
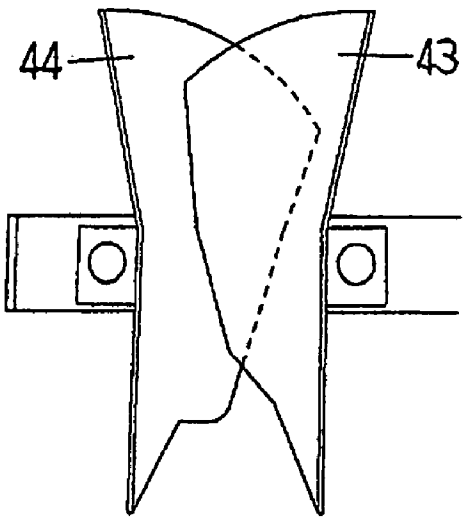
Figure 5A:
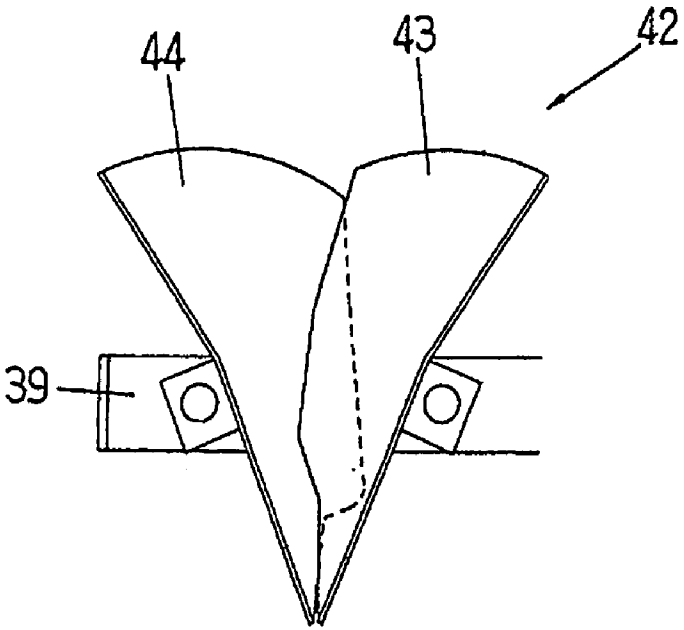
Figure 6:
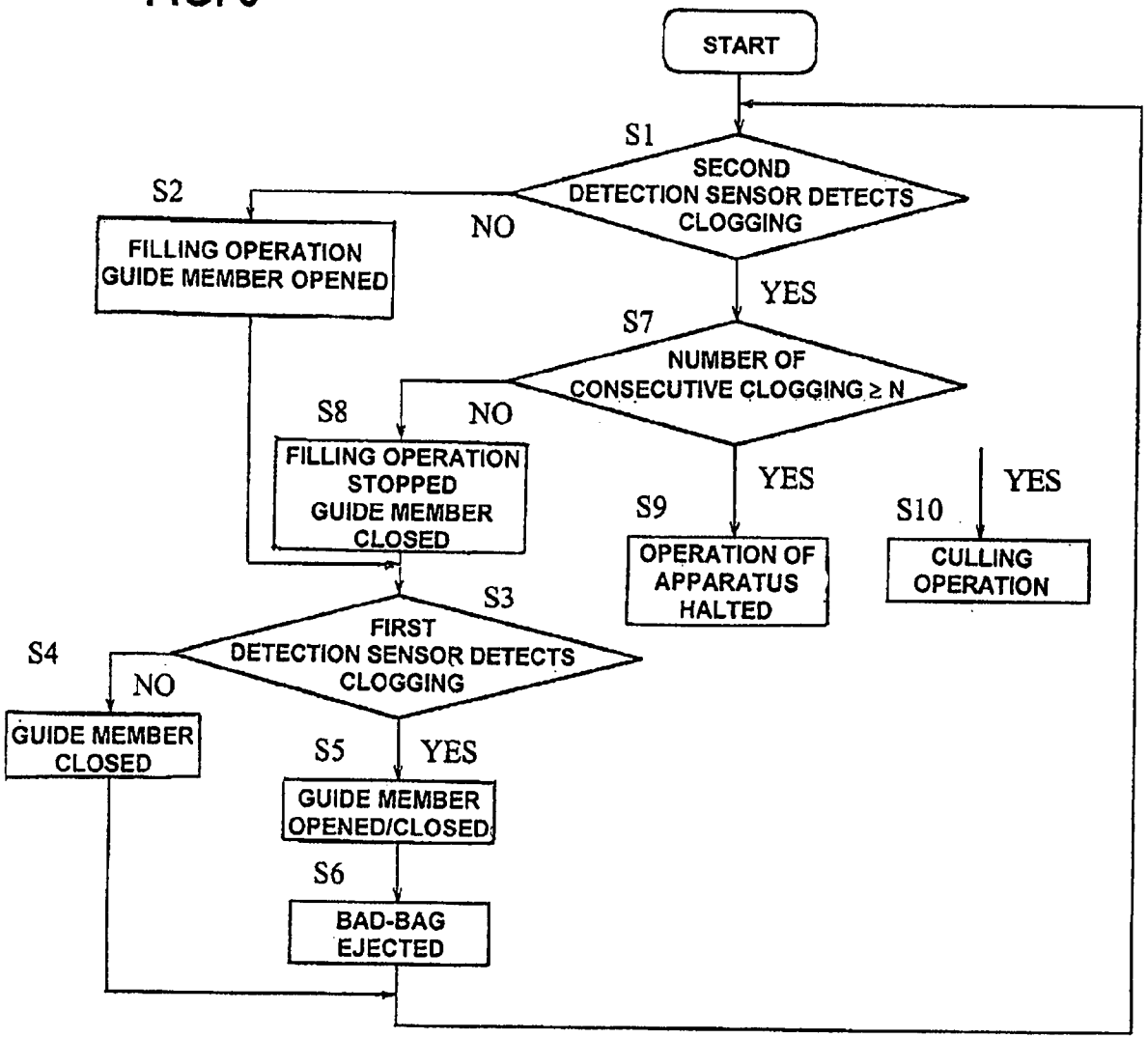
FIG. 6 is a flowchart showing the control procedure based on the detection signals from the first and second detection sensors.

Because of the above-described construction of the guide member 42 and its drive mechanism, when the air cylinder 54 is actuated, the L-shaped lever 48 rocks, the support shafts 45 and 46 simultaneously rotate in opposite directions, and the guide member 42 is opened and closed directly below the hopper 41 (guide frames 43 and 44 simultaneously rock and open and close in directions opposite to each other). When the guide member 42 is closed (or when the guide frames 43 and 44 are closed), as shown in FIG. 5(*a*), the guide member 42 has a shape in which it narrows at the bottom, thus closing the bottom end and preventing the product inside from dropping while also permitting the bottom end to be inserted into the bag mouth; and when the guide member 42 is open (or when the guide frames 43 and 44 are open), as shown in FIG. 5(*b*), the bottom end of guide member 42 widens, thus allowing the product inside the guide member 42 to drop.

In operation of the bag filling and packaging apparatus described above, when the table 24 turns, the endless chain 1 and the grippers 2 are moved respectively along the racetrack-shaped annular track, while the hoppers 41 and guide members 42 are respectively moved along the circular track. This circular track is, as seen from FIG. 1, divided into a two regions: a filling region A and a non-filling region B. The filling region A is an arc-shaped region where the hoppers 41 and guide members 42 are moved along the semicircular portion of the annular track for the grippers 2, and the non-filling region B is an arc-shaped region where the hoppers 41 and guide members 42 are moved away from the semicircular portion of the annular track for the grippers 2. In the filling region A, the hoppers 41 and the guide members 42 are moved above the grippers 2 and synchronized with the grippers 2, and they are also raised and lowered. Over the entire length of the non-filling region B, a receiving member 40 that receives products that drop from the guide members 42 (the dropping of product is to be described later) is provided at a height that does not interfere with the guide members 42 in their standby positions and the bags 9 that are held by the grippers 2.

When a moving hopper 41 and guide member 42 are moved from the non-filling region B into the filling region A (at this time, the air cylinder 54 is actuated toward the rear and the guide member 42 are closed), the hopper 41 and guide member 42 which have been in their upper standby positions in the non-filling region B are, by the interaction between the cam roller 35 and the annular cam 36, lowered and the closed lower-end portions of the guide members 42 are inserted into the bag mouth of a bag 9 held by the gripper 2 (see guide member 42 on the right side of FIG. 2).

Next, the air cylinder 54 is actuated toward the front so that the guide member 42 is opened, product is loaded into the hoppers 41 and the product drops from the hopper 41 along the guide member 42 into the bag 9. Just before the hopper 41 and the guide member 42 are moved from the filling region A into the non-filling region B, due to the interaction between the cam roller 35 and the annular cam 36, the hopper 41 and guide member 42 are raised and returned to the standby position (see guide members 42 on the left side of FIG. 2), and then the guide member 42 is closed. Described above is the basic operation of the hoppers 41 and guide members 42.

As seen from FIG. 1, the filling device 5 has a first detection sensor 57 installed near the starting end of the non-filling region B, and a second detection sensor 58 is installed near the finishing end of non-filling region B. The first and second detection sensors 57 and 58 are each a transmission-type photoelectric sensor respectively made up of light emitting elements 57*a* and 58*a* and light receiving element 57*b* and 58*b*. On the other hand, as seen from FIG. 3, a hole is formed in one of the guide frames, the guide frame 44 in the shown structure, of each of the guide members 42, so that a transparent window 59 is formed thereon. As the guide members 42 successively pass by the detection positions (the positions where the first and second detection sensors 57 and 58 are installed), the respective light emitting elements 57*a* and 58*a* respectively emits light at the command of a control unit 61, the emitted light passes through the window 59 and is received by the respective light receiving element 57*b* and 58*b*. However, if the guide member 42 is clogged with product, the light receiving element 57*b* and 58*b* cannot receive the light. Thus, a determination can be made as to whether or not clogging is present in the guide members 42 based on whether or not the light receiving elements 57*b* and 58*b* are able to receive the light.

The control unit 61 is set that it performs such control as described below, for instance, for each of the guide members 42 based on the detection signals from the first detection sensor 57.

(1) Determine whether or not a guide member 42 passing through the detection position for the first detection sensor 57 is clogged with product.

(2) If the guide member 42 is determined to be clogged, repeatedly actuate the air cylinder 54 so that its piston rod 55 is moved forward and backward, thus repeatedly opening and closing the guide frames 43 and 44 and then finally closing them.

(3) If the guide member 42 is determined to be clogged, cause the bad-bag ejecting device 7 to actuate when the gripper 2 corresponding to the clogged guide member 42 (the one that have been moving synchronously with and below the guide member 42 in the filling region A) reaches the bad-bag ejection position, thereby opening that gripper 2.

The control unit 61 is set further so that it performs such a control as described below, for example, for each of the guide members 42 based on the detection signals from the second detection sensor 58.

(4) Determine whether or not a guide member 42 passing through the detection position for the second detection sensor 58 is clogged with product.

(5) If the guide member 42 is determined to be clogged, halt the introduction of product by the filling device 5 into the hopper 41 that corresponds to the clogged guide member 42.

(6) If the guide member 42 is determined to be clogged a predetermined number of times in a row, halt the bag supply device 3 to supply bags 9 to the gripper 2 corresponding to that guide member 42, or halt the operation of the bag filling and packaging apparatus.

The control algorithm illustrated in (1) through (6) above is performed for each of the guide members 42 based on the detection signals of the first and second detection sensors 57 and 58. An example of the control procedure will be described below with reference to the flowchart shown in FIG. 6.

Step S1: Based on the detection signals from the second detection sensor 58, determination is made whether or not a guide member 42 passing through the detection position for the second detection sensor 58 is clogged (see FIG. 3).

Step S2: If no clogging is determined based on the detection signals from the second detection sensor 58, the normal filling operation is performed for this guide member 42 in the filling region A. In other words, the closed guide member 42 is inserted into a bag mouth, the air cylinder 54 is actuated to open the guide member 42, the corresponding hopper 41 is loaded with product and thus perform the filling of the bag 9 with the product, and then the hopper 41 and guide member 42 are raised, and the guide member 42 is closed.

Step S3: When this guide member 42 arrives at the non-filling region B, based on the detection signals from the first detection sensor 57, determination is made on whether or not the guide member 42 passing through the detection position is clogged.

Step S4: If no clogging is determined based on the detection signal from the first detection sensor 57, the guide member 42 is kept closed; and the normal product ejection operation is performed with respect to the gripper 2 corresponding to that guide member 42. In other words, when the gripper 2 corresponding to that guide member 42 arrives at the product ejection position, the product-bag ejecting device 8 opens the gripper 2 so that the product-bag is ejected.

Step S5: If clogging is determined to be present based on the detection signals from the first detection sensor 57, the piston rod 55 of the air cylinder 54 for that guide member 42 is actuated forward and backward so as to repeatedly open and close the guide frames 43 and 44 of that guide member, and then the guide member 42 is closed. By repeatedly opening and closing the guide frames 43 and 44, there is a good possibility of the product therein dropping and the clogging be cleared. Any product that drops is received by the receiving member 40.

Step S6: Additionally, an actuation command for the bad-bag ejecting device 7 is issued. More specifically, the bag held by the gripper 2 corresponding to the guide member 42 determined to be clogged is determined to be a bad bag (a bag that is partially filled with product or not filled at all), so that the bad-bag ejecting device 7 is, when that gripper 2 arrives at the bad-bag ejection position, actuated to open the gripper 2 and drop the bad bag.

Step S7 : If clogging is determined to be present based on the detection signals from the second detection sensor 58, then a further determination is made on whether the number of consecutive determinations of clogging present in that guide member 42 is less than N (N times) or N or greater (N times or more). A value of 2 or greater is assigned for the number N.

Step S8: If the number of consecutive determinations of clogging present in that guide member 42 is less than N, then the normal filling operation for that guide member 42 is not performed in the filling region A. In other words, the guide frames 43 and 44 of that guide member 42 are not opened, and the loading of product to the corresponding hopper 41 is stopped.

Step S9: If the number of consecutive determinations of clogging present in that guide member 42 is N or greater, then the operation of the packaging apparatus is halted, the clogging is manually cleared, and then the operation of the apparatus is resumed. Consecutive determinations of clogging mean that repeated opening and closing operations for the guide frames 43 and 44 in the non-filling region B are not sufficient to clear the clogging of the guide members 42; and in this case, automatic clearing of clogging is deemed to be impossible, and thus the operation of the apparatus is halted.

Step S10: Alternately, if the number of consecutive determinations of clogging present in that guide member 42 is N or greater, a culling operation for that guide member 42 is performed. In other words, the supply of a bag 9 to the gripper 2 corresponding to the guide member 42 whose clogging could not be cleared is hauled, and loading of product for the corresponding hopper 41 is not performed. In this case, the supply of bag is halted to one out of twelve grippers 2 installed on the chain 1 (in the case in which one guide member 42 is clogged). As the number of clogged guide members 42 increases, the decrease in productivity is exacerbated; accordingly, if the number of clogged guide members 42 reaches a predetermined number (for example, two), it is preferable to halt the packaging apparatus, so that the clogging for all guide members 42 is cleared.

In the above-described bag filling and packaging apparatus, transmission-type photoelectric sensors are used for the first and second detection sensors 57 and 58; however, each of these may be replaced with any of the reflection-type photoelectric sensors, limit switches, strain gauges or other sensors disclosed in the above-described Japanese Patent No. 2,745,203 as long as the first detection sensor 57 that uses such alternate sensor detects the presence of clogging within the guide member to be detected immediately after the product filling step for first detection sensor 57, and as long as the second sensor 58 that uses such alternate sensor detects the presence of clogging within the guide member immediately before the product filling step for second detection sensor 58.

In addition, in the above-described bag filling and packaging apparatus, the presence of clogging within a guide member 42 is detected by the first detection sensor 57, and the guide frames 43 and 44 of that guide member 42 are repeatedly opened and closed within the non-filling region B only in the case in which clogging is determined to be present; however, it is also possible to perform the repeated opening and closing operation for the guide frames 43 and 44 regardless of the results of detection.

The invention claimed is:

1. A bag filling and packaging apparatus comprising:

an endless chain that travels along a racetrack-shaped annular track, and a plurality of pairs of grippers that are provided on said endless chain at equal intervals along a length of said endless chain and moved together with said endless chain, and further, a bag supply device, a bag mouth opening device, a filling device and a sealing device that are among others disposed along said annular track;

wherein said filling device has a plurality of ascending/descending hoppers that are provided above one of arc-shaped sections of said annular track and are moved, in synchronism with said grippers, along its own circular track which is concentric to said one of said arc-shaped sections, and during a movement of said grippers, a packaging operation is performed including, among others, supply of bags to said grippers by said bag supply device, holding of edges of the bags by said grippers, opening of a bag mouth by said bag mouth opening device, filling of the bag with product by each one of said hoppers by said filling device, and sealing of the bag mouth by said sealing device;

wherein a guide member that is hollow inside and guides product dropping from said hopper into the bag is provided under each one of said hoppers;

said guide member is comprised of a pair of guide frames, which are disposed to face each other and able to open and close, and is moved and raised/lowered together with said each one of said hoppers, and when said pair of guide frames are closed, said guide member narrows at a bottom thereof and a lower end thereof can thus be inserted into the bag mouth, and when said guide frames are opened, said guide member widens at its lower end;

a guide frame actuating means that opens and closes said pair of guide frames is provided;

said pair of guide frames are repeatedly opened/closed by said guide frame actuating means in an arc-shaped non-filling region of a circular track of said guide member; and a receiving member that receives a product that drops from said guide member is provided at a position directly below said guide member in said non-filling region.

2. The bag filling and packaging apparatus according to claim 1, wherein said bag filling and packaging apparatus further comprises:

a first detection sensor that detects presence of product within said guide member immediately after the filling of the bag with product, and a control unit that determines presence of clogging of product in a guide member based on detection signals from said first detection sensor and controls actions of said guide frame actuating means; and upon determining that clogging of product is present in a guide member, said control unit causes said guide frame actuating means to perform an action in which said pair of guide frames of the guide member determined to be clogged with product are repeatedly opened and closed in said non-filling region.

3. The bag filling and packaging apparatus according to claim 1, wherein said bag filling and packaging apparatus further comprises:

a first detection sensor that detects presence of product within said guide member immediately after the filling of the bag with product, a bad-bag ejecting device that, at a position different from a good-product ejection position, opens said gripper and ejects from said bag filling and packaging apparatus a bag that has been held by said gripper, and a control unit that determines presence of clogging of product in a guide member based on detection signals from said first detection sensor and controls actions of said bad-bag ejecting device; and upon determining that clogging of product is present in a guide member, said control unit causes said bad-bag ejecting device to perform an action to open a gripper that corresponds to a guide member determined to be clogged with product.

4. The bag filling and packaging apparatus according to claim 1, wherein said bag filling and packaging apparatus further comprises:

a second detection sensor that detects presence of product within said guide member immediately before the filling of the bag with product, and a control unit that determines presence of clogging of product based on detection signals from said second detection sensor and controls actions of said filling device; and upon determining that clogging of product is present in a guide member, said control unit causes said filling device to halt supply of product to a hopper that corresponds to a guide member determined to be clogged with product.

5. The bag filling and packaging apparatus according to claim 4, wherein upon determining that a specific guide member is clogged with product a predetermined number of times in a row based on detection signals from said second detection sensor, said control unit causes said bag supply device to halt supply of bags to a gripper that corresponds to the guide member.

6. The bag filling and packaging apparatus according to claim 4, wherein upon determining that a specific guide member is clogged with product a predetermined number of times in a row based on detection signals from said second detection sensor, said control unit halts operation of said bag filling and packaging apparatus.

7. The bag filling and packaging apparatus according to claim 1, wherein said bag filling and packaging apparatus further comprises:

a first detection sensor that detects presence of product within said guide member immediately after the filling of the bag with product, a bad-bag ejecting device that, at a position different from a good-product ejection position, opens said gripper and ejects from said bag filling and packaging apparatus bags that have been held by said gripper, and a control unit that determines presence of clogging of product in a guide member based on detection signals from said first detection sensor that controls actions of said guide frame actuating means and bad-bag ejecting device; and upon determining that clogging of product in a guide member is present, said control unit causes said guide frame actuating means to perform an action in which pair of guide frames of said guide member determined to be clogged with product are repeatedly opened and closed in said non-filling region, and causes said bad-bag ejecting device to perform an action to open a gripper that corresponds to a guide member determined to be clogged with product.

8. The bag filling and packaging apparatus according to claim 1, wherein said bag filling and packaging apparatus further comprises:

a first detection sensor that detects presence of product within said guide member immediately after the filling of the bag with product, a second detection sensor that detects presence of product within said guide member immediately before the filling of the bag with product, and a control unit that determines presence of clogging of product based on detection signals from said first detection sensor and thus controls actions of said guide frame actuating means, and determines presence of clogging of product based on detection signals from said second detection sensor and thus controls actions of said filling device; and upon determining that clogging of product is present based on detection signals from said first detection sensor, said control unit causes said guide frame actuating means to perform an action in which the pair of guide frames of a guide member determined to be clogged with product are repeatedly opened and closed in said non-filling region; and upon determining that clogging of product is present based on detection signals from said second detection sensor, said control unit causes said filling device to halt supply of product to a hopper that corresponds to a guide member determined to be clogged with product.

9. The bag filling and packaging apparatus according to claim 8, wherein upon determining that a specific guide member is clogged with product a predetermined number of times in a row based on detection signals from said second detection sensor, said control unit causes said bag supply device to halt supply of bags to a gripper that corresponds to the guide member.

10. The bag filling and packaging apparatus according to claim 8, wherein upon determining that a specific guide member is clogged with product a predetermined number of times in a row based on detection signals from said second detection sensor, said control unit halts operation of said bag filling and packaging apparatus.

* * * * *